United States Patent [19]

Chen

[11] Patent Number: 4,686,842

[45] Date of Patent: Aug. 18, 1987

[54] SLIDING PLATE CONTROL DEVICE OF NUMERICAL LOCK FOR BRIEF CASE

[76] Inventor: Han-Jing Chen, 32-1, Yen Tso Lane, Hai pu Lee, Lu Kang County, Chang Hua Hsien, Taiwan

[21] Appl. No.: 866,121

[22] Filed: May 22, 1986

[51] Int. Cl.[4] ..... E05B 37/02

[52] U.S. Cl. ..... 70/312; 70/316

[58] Field of Search ..... 70/312, 315, 316, 317, 70/318, 66–76

[56] References Cited

U.S. PATENT DOCUMENTS 4,327,566 5/1982 Ling ..... 70/312

4,441,346 4/1984 Castiglioni ..... 70/312

*Primary Examiner*—Robert L. Wolfe

*Attorney, Agent, or Firm*—Bucknam and Archer

[57] ABSTRACT

The invention is related to an improved device of sliding plate numerical lock, in which it is featured that the mutually fitted sliding plate, axial rod, cover, and body are all improved, thus, the lock opening and the number changing can be done by operating a single buttom, further more, because of the adoptation of lugs and clipping slots, the assembling work of the whole lock structure can be made faster; consequently the production cost is thereby reduced.

3 Claims, 5 Drawing Figures

SLIDING PLATE CONTROL DEVICE OF NUMERICAL LOCK FOR BRIEF CASE

BACKGROUND OF THE INVENTION

It is known that the traditional sliding plate numerical locks, as they are widely adopted on brief cases nowaday, possess locking, unlacking, and remembering functions, but these functions are performed by two buttons, one on front side of the lock other one on back side of the lock; the front side buttom is used to serve unlocking purpose by push it rightward; the back side buttom is used to remmber the unlocking numerical number by push it leftward. Furthermore, the cover and the body of the traditional brief case numerical lock are press formed one piece parts, and they are fixed together by bending the protruded tooth on cover onto the upper side of the body, thus the following shortcomings can be found:

1. Inconvenient to operate:
   Because the unlocking buttom and renumbering buttom are provided at front side and back side of the lock respectively, therefore, when renumbering of the lock is required, the brief case should be first opened, then renumbering operation is done at the inside of the brief case.
2. Low production efficiency:
   Because two buttoms are provided on traditional numerical lock, one on front side, one on back side, in addition to cover and body of the lock are fixed together by bending the protruded tooth on cover onto the upper side of the body, therefore, more cost will be spent on parts and more assembling work will be needed.
3. Higher production cost:
   Because more parts are required to produce a traditional numerical lock, also cover and body of the traditional numerical lock are made by metal plate, consequently its production cost will become higher.

SUMMARY OF THE INVENTION

The invention is to provide a brief case numerical lock, especially a single buttom located on the front side of the said lock, which is used to unlocking and renumbering of the said numerical lock, an a fast assembling cover and body design of the said lock to reduce the production cost of the said lock as follows:

1. Single buttom type shaftlever:
   The specific feature of the invention is the special structural combination of a symmetrically fitled sliding plate, shaft lever, and a buttom which is located on front side of the numerical lock and it is used to serve both unlocking and renumbering of the numerical unlocking number purposes.
2. Reduction of production cost:
   In addition to a single buttom is provided to serve unlocking and renumbering purpose of the numerical lock, plastic material instead of metal plate is used to manufacture the cover and the body of the said numerical lock, consequently the production cost of the said numerical lock can be reduced.

Furthermore, the main objective of the invention, "Sliding plate control device of numerical lock for briefcase", is to provide a numerical lock with simplfied unlocking and renumbering operation. The next objective of the invention, "Sliding plate control device of numerical lock for briefcase", is to provide a structural improvement of the said numerical lock for better quality and lower production cost.

DESCRIPTION OF THE PREFERRED EMBODIMENT

Figure 1:
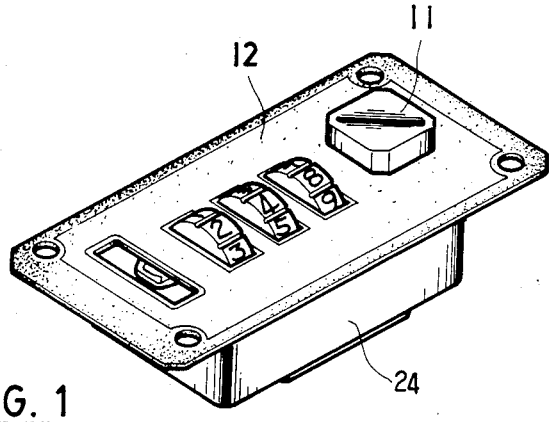
FIG. 1 is the incarnation appearience example of the invention.
Figure 2:
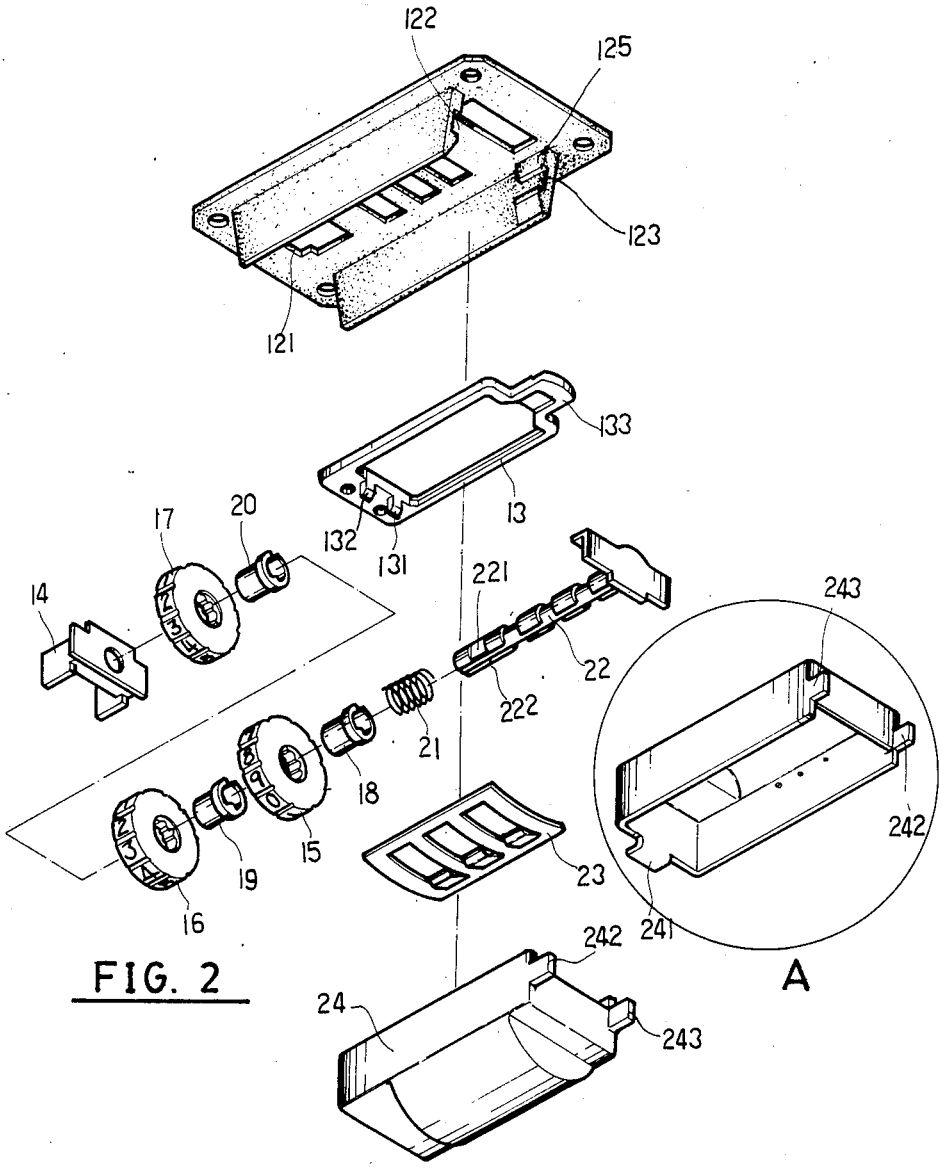
FIG. 2 is the parts break down drawing of the invention and FIG. A is the view of turned housingbody.

Please refer to FIGS. 1 and 2, the invention comprises a buttom(11), spacing cover(12), sliding plate(13) which is connected to buttom(11) to form a movable control buttom, spring(21), sleeves(18)(19)(20), numerical number wheels(15) (16)(17), and passive plate(14), shaftlever(22), locating plate(23), body(24). In which, the structure and its assembling method of shaftlever(22), spring(21), sleves(18) (19)(20), numerical number wheels, and passive plate(14) are similar to traditional numerical lock, therefore, it is omitted. The improved structures of the invention can be descripted in two point: First, the longitudinal cut-aways(221)(222) on end of shaftlever(22) are fitted into the space between protruded clips(131)(132) of sliding plate(13), therefore, the buttom(11) on outer side of cover(11) can be used to control sliding plate(13) to move leftwardly or rightwardly (note: leftward movement is used for renumbering of the numerical lock, right ward movement is used for unlocking of the numerical lock), when these movements, leftwardly and rightwardly, acting on longitudinal cut-aways(221)(222) on left end of shaft lever(22) through protruded clips(131)(132) on sliding plate(13), due to the function of passive plate(14), the sleeves(18)(19)(20) or numerical number wheels(15)(16)(17) on shaft lever (22) will actuated to perform its renumbering or unlocking function. Second, the fitting and structure of cover(12) and body (24) uas been improved, in which, a cliping block (241) is provided on one end of the body(24), and 2 lngs(242(243) are provided on other end of the body (24), and the body (24) is fitted to cover(24), these component parts said above, are made by phastics, the opening (121) is not only used to install buttom (11), but it is also to be used to receive cliping block(241), the cliping slats(122)(123) at the other side of the cover(12) mainly comprise conical block(124) and rectanqular block(125), the advantage of these improved structures is that the two body component parts can be rapidly assembled into one unit. Furthermore, when these one unit numerical locks are paired and installed in presaved slots of a briefcase, they will never become looseness and sliding.

Figure 3A:
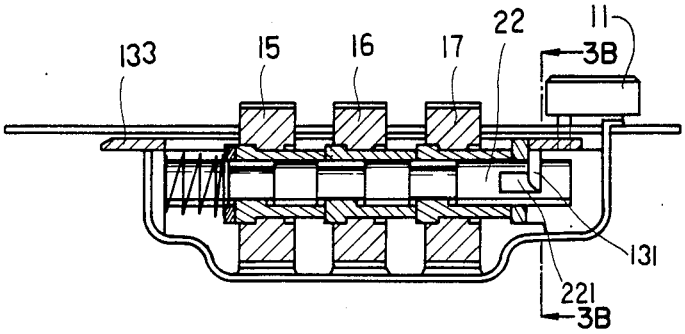
FIG. 3 is the cut-away view of the assembled parts of the invention.
Figure 3B:
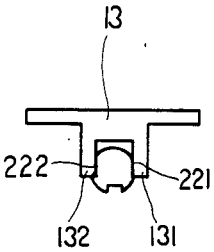
Figure 4A:
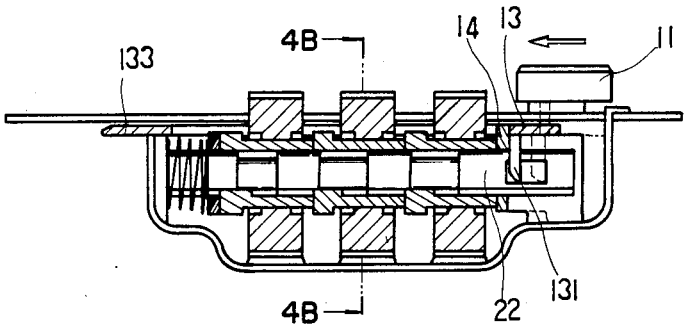
FIG. 4 is the incarnation example drawing of the invention under renumbering operation.
Figure 4B:
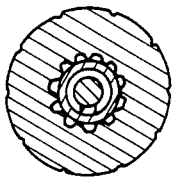
Figure 5A:
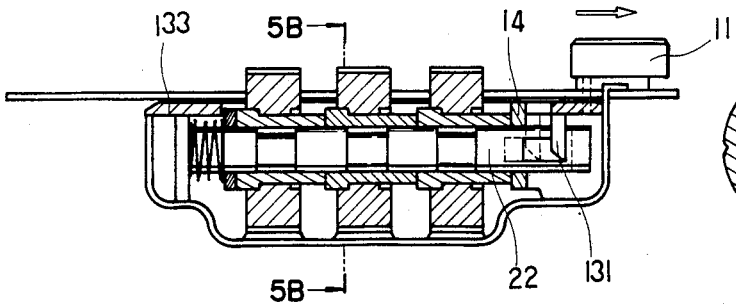
FIG. 5 is the incarnation example drawing of the invention under unlocking operation.
Figure 5B:
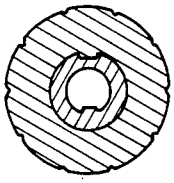

Please refer to FIGS. 3 to 5, in FIG. 3 it can be seen that sliding plate(13) is installed in the lock body, and protruded clips (131)(132) are clipped on right side of cut-aways (221)(222) at the end of shaft lever(22). During unlocking (as shown in FIG. 5), numerical number wheels are turned to the pre-set numbers, at this time, shaft lever (22) can be -oved inside sleeves(18)(19)(20), when buttom (11) is pushed to right, protruded clips(131)(132) will act on shaft lever(22) to cause it to move to the right, and lip(133) of sliding plate(13) moves to the left, thus the unlocking purpose thence served.

When renumbering of the number of the numerical lock is required (as shown in FIG. 4), the buttom (11) is pushed to the left, which causes protruded clips(131) (132) to push passive plate(14) and sleves (18)(19)(20) to the left, thus numerical number wheels are disengaged from the sleeves, and renumbering can be performed at this time.

I claim:

1. In a lock for a briefcase comprising a cover (12), a movable knob (11) on the outer surface of said cover, a sliding plate (13) connected to said knob, a body (24) fixed to said cover, numerical dial wheels (15, 16, 17) located on said cover, sleeves (18 19, 20) for said dial wheels, a shaft (22) movable within said sleeves, a second plate (14) mounted on said shaft, the sliding plate (13) being slidably mounted on said shaft and a spring (21) urging said sliding plate towards said second plate, the improvement which comprises two longitudinal cut-outs (221, 222) at one end of said shaft (22) said sliding plate (13) having two protrusions (131, 132) which fit in the space between said cut-outs, said knob (11) controlling the sliding plate to move to the left or to the right when force is applied to said plate (14).

2. The lock according to claim 1 wherein said body (24) has a protrusion (241) at one end and two lugs (242, 243).

3. The lock according to claim 1 wherein said cover (12) has clipping slots (122, 123) at one end thereof and at the other end an opening (121) for installation of the knob.

* * * * *